United States Patent [19]

Sagawa

[11] Patent Number: 4,876,761

[45] Date of Patent: Oct. 31, 1989

[54] PIN FOR SWEEPERS

[76] Inventor: Shizuo Sagawa, 12-8, Minami Kugahara 1-chome,, Ota-ku, Japan

[21] Appl. No.: 154,228

[22] Filed: Feb. 10, 1988

[30] Foreign Application Priority Data

Jul. 31, 1987 [JP] Japan ..... 62-117773
Jul. 31, 1987 [JP] Japan ..... 62-117774

[51] Int. Cl.[4] ..... B08B 9/04

[52] U.S. Cl. ..... 15/104.061; 15/236.01; 29/81 G

[58] Field of Search ..... 15/104.061, 104.062, 15/1, 93 R, 236.01, 236.06, 236.08, 236.1; 29/81 D, 81 G, 81 J; 299/79, 88, 91

[56] References Cited

U.S. PATENT DOCUMENTS 1,727,915 9/1929 Thomson ..... 29/81 D
4,244,073 1/1981 Sagawa ..... 15/104.061

*Primary Examiner*—Edward L. Roberts

*Attorney, Agent, or Firm*—Finnegan, Henderson, Farabow, Garrett & Dunner

[57] ABSTRACT

A pin for a sweeper used to scrape scale off the inner wall of a pipe has a shaft portion, an anchoring portion at the lower end of the shaft portion for being driven into the sweeper body to prevent the pin from falling out, and a head portion at the upper end of the shaft portion. The head portion has a plurality of spaced, generally pyramidal projections for contacting and scraping off scale. The projections are arranged in such a manner that the tip portions thereof do not overlap one another when the head portion is viewed from the side. The head portion may alternatively include a plurality of staked plate-shaped bodies each of which has corner portions. The plate-shaped bodies are stacked on one another and are successively angular offset in the same direction in such a manner that equal angles are formed between corresponding corner portions of mutually adjacent ones of the plate-shaped bodies.

7 Claims, 3 Drawing Sheets

PIN FOR SWEEPERS

BACKGROUND OF THE INVENTION

This invention relates to a pin driven into a sweeper made of a synthetic resin for scraping scale from the inner wall of a pipe.

Scale or slag can deposit on the inner wall of a pipe for supplying water, petroleum or various types of gases and can eventually reduce the effective cross sectional area of the pipe and thus impede the flow of fluids therethrough. For this reason, the inner wall surface of the pipe is cleaned periodically to remove the scale.

To clean a pipe of the type described, a sweeper (also referred to as a "pig") made of synthetic resin and having a conical portion at its forward end is inserted into the pipe while being elastically deformed, hydraulic pressure is applied to the rearward end of the sweeper within the pipe, and the scale on the inner wall of the pipe is scraped off by the sweeper while the sweeper is advanced through the pipe by a difference in pressure between the forward and rearward end of the sweeper. The scraping off of the scale is actually performed by the heads of a number of metal pins driven in toward the center of the sweeper from the outer peripheral surface thereof. The heads of these pins advance together with the sweeper while being brought into pressured contact with the inner wall of the pipe and strike the scale to remove the same from the inner wall. The pins are made of a material not as hard as that of the pipe and somewhat harder than that of the scale or slag to be scraped off from the inner wall of the pipe.

Pins of this type and a sweeper equipped with the pins have already been proposed by the inventor in Japanese Patent Publication (KOKOKU) No. 58-36634 and Japanese Utility Model Publication (KOKOKU) No 58-45831.

The heads of these pins have a generally square shape or a round configuration the outer surface of which is formed to include grooves of a grid-like pattern. Since it is impossible to replace these pins after they are driven into the sweeper, the sweeper reaches the end of its service life when the pin heads are worn too much to scrape off the scale. In the case of the square head, for example, the corner portions become rounded due to wear. With the head having the round configuration, wear can cause the grooves to vanish completely. In either case, the sweeper will loose its ability to scrape off scale, so that a new sweeper must be used in place of the old.

Since the ability of the pins to scrape off scale is directly linked to the service life of the sweeper, the shape of the pins is a very important factor in determining the life of the sweeper.

SUMMARY OF THE INVENTION

Accordingly, an object of the present invention is to provide a sweeper pin having a head so adapted that the scale scrape-off ability of the head will not diminish.

According to the present invention, the foregoing object is attained by providing a pin for a sweeper comprising a shaft portion, an anchoring portion provided at a lower end of the shaft portion for being driven into the sweeper to prevent the pin from falling out of the sweeper, and a head portion provided at an upper end of the shaft portion, the head portion having a plurality of spaced, pointed projections having respective tip portions, the projections being disposed in such a manner that the tip portions thereof have a non-overlapping arrangement when the head portion is viewed from a side thereof.

In a preferred embodiment, the pointed projections are of a generally triangular pyramidal shape or generally quadrangular pyramidal shape.

The spaced tip portions of the pointed projections provided on the pin head strike the scale on the inner wall of a pipe and effectively scrape the scale off the pipe. Even if some of the tip portions sustain wear, the remaining tip portions on the other pyramidal projections will still scrape off the scale. The result is a pin having a longer lifetime.

Since the tip portions of the projections are spaced apart from one another, some of these projections will strike the scale on the inner wall of the pipe and the scraped off scale can be removed through the spaces between the projections. Since these projections are generally pyramidal in shape, the tip portions remain comparatively sharp even if they sustain wear.

Further, according to the present invention, the foregoing object is attained by providing a pin for a sweeper comprising a shaft portion, an anchoring portion provided at a lower end of the shaft portion for being driven into the sweeper to prevent the pin from falling out of the sweeper, and a head portion provided at an upper end of the shaft portion, the head portion comprising a plurality of stacked plate-shaped bodies- each of which has corner portions.

In a preferred embodiment, the plate-shaped bodies are stacked on one another and are successively angularly offset in the same direction in such a manner that equal angles are formed between corresponding corner portions of mutually adjacent ones of the plate-shaped bodies.

In another embodiment of the invention, the plate-shaped bodies are stacked radially in such a manner that the corner portions thereof define vertically extending straight lines.

Since a number of the corner portions of the plate-shaped bodies are arrayed in close proximity to one another, the corner portions do not wear down at the same time, thus making it possible to prolong the service life of the pin.

The pin of the present invention is advantageous in that even if the head sustains wear, a new plate-shaped body will become exposed from the worn portion, thus enabling the pin to be used effectively until the entirety of the head is worn down.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

Figure 3:
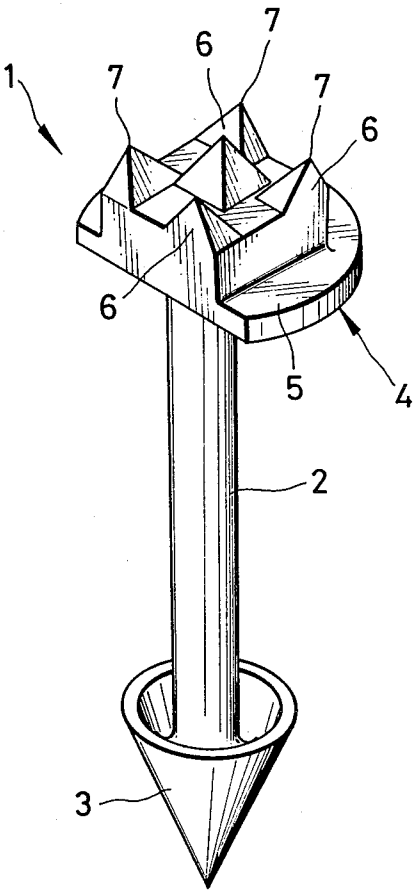
FIG. 3 is a perspective view of the pin.
Figure 2:
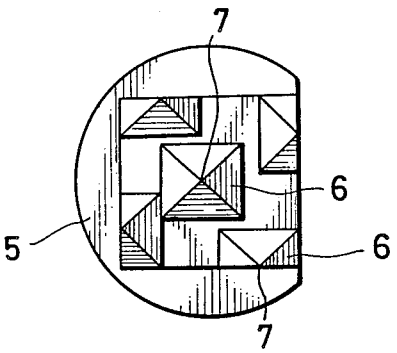
FIG. 2 is a plan view showing the pin of FIG. 1.
Figure 1:
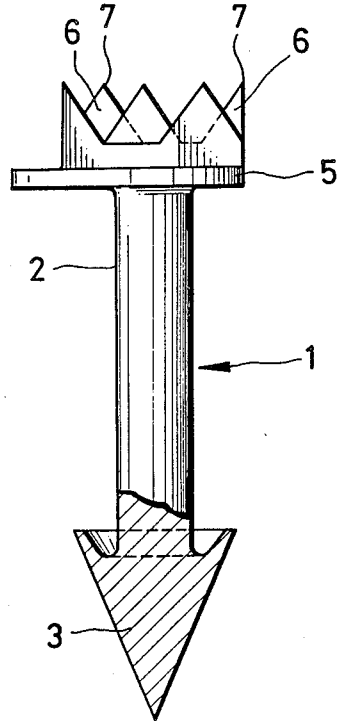
FIG. 1 is a side view illustrating an embodiment of a sweeper pin according to the present invention.

Referring to the drawings, a sweeper pin 1 in accordance with the invention is made of metal and includes a stem 2, an anchoring portion 3 provided at the lower end of the stem 2 for preventing the pin 1 from falling out of the sweeper body (not shown) after the pin has been driven into the sweeper body, and a head 4 provided at the upper end of the stem 2.

The head 4 comprises a circularly shaped flat plate 5, and a plurality of spaced, pointed projections 6 formed on the flat plate 5 and having tip portions 7. The pointed projections 6 can be a combination of triangular and quadrangular pyramids, by way of example, and are arranged in such a manner that the tip portions 7 thereof will not lie on the same straight line and will not overlap one another when viewed from the side.

This arrangement of the projections 6 is advantageous in that even if some of the tip portions 7 sustain wear by scraping off scale, the remaining tip portions 7 will still have a scale scrape-off capability, thus making it possible to keep the sweeper in service longer. It should be noted that since a number of the pins 1 are driven into the synthetic resin sweeper body in close proximity to one another, in actual practice it is impossible for all of the projections 6 do sustain wear uniformly and at one time.

Referring to FIGS. 4 through 7 to understand other embodiments, a sweeper pin 11 in accordance with the invention is made of metal and includes a stem 12, an anchoring portion 13 provided at the lower end of the stem 12 for preventing the pin 11 from falling out of a sweeper body (not shown), which is made of a synthetic resin, after the pin has been driven into the sweeper body, and a head 14 provided at the upper end of the stem 12.

Figure 4:
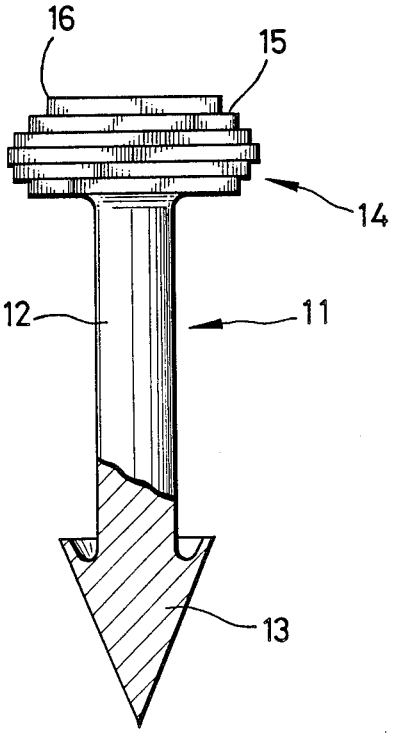
FIG. 4 is a side view illustrating another embodiment of a sweeper pin according to the present invention.
Figure 5:
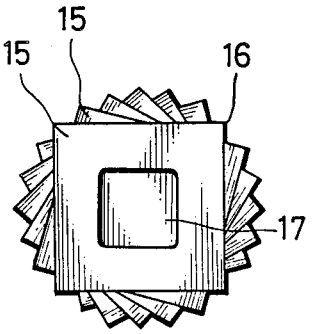
FIG. 5 is a plan view showing the pin of FIG. 4.
Figure 6:
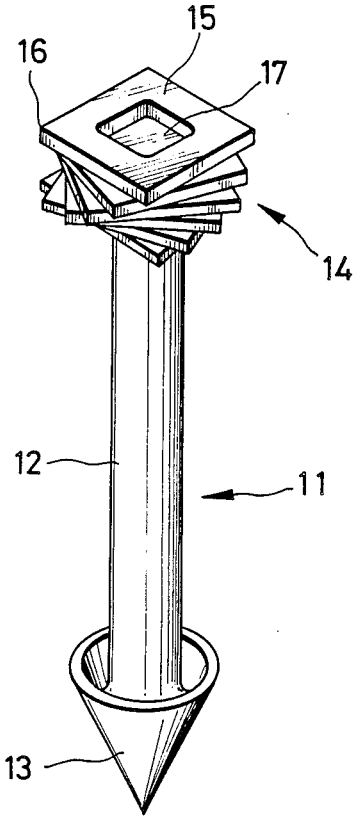
FIG. 6 is a perspective view of the pin and shows a groove formed in the head of the pin.
Figure 7:
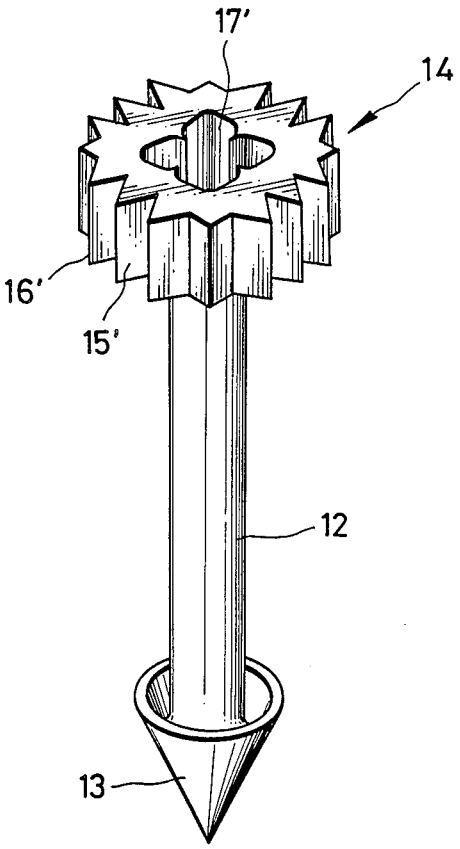
FIG. 7 is a perspective view showing another embodiment of a sweeper according to the present invention.

In the second embodiment of FIGS. 4 through 6, the head 14 comprises e.g. six square, plate-shaped bodies 16 each having a thickness of 12 mm and dimensions of 20×20 mm, and the plate-shaped bodies 16 are stacked on one another, the plate-shaped bodies 16 being successively angular offset in the same direction in such a manner that an angle of 15° is formed between corresponding corner portions 15 of mutually adjacent ones of the plate-shaped bodies. The configuration obtained by stacking these six square, plate-shaped bodies 16 is molded into an integral body by a lost wax process.

As shown in FIGS. 5 and 6, the upper surface of the head 14 may be formed to include a rectangular groove 17 to assure the resilience of the head 14 when the corner portions 15 of the head contact the inner wall of a pipe or scale affixed to the inner wall. In order to provide a gate used in the lost wax process, at least one side portion can be made a vertical surface without a corner portion.

In the embodiment of FIGS. 4 through 6, the plate-shaped bodies are stacked vertically. As illustrated in the third embodiment of FIG. 7, however, the plurality of plate-shaped bodies may take the form of a single gear-shaped body 15' having corner portions 16' thereof that define vertically extending straight lines parallel to the stem 12. A groove 17' may be provided in the upper surface of the head 14 at the center thereof to assure the resilience of the head. Since a number of the corner portions 16' are arrayed in close proximity to one another, these corner portions 16' will not be worn down at one time. This assures that the pin will have a high scale scrape-off capability.

As many apparently widely different embodiments of the present invention can be made without departing from the spirit and scope thereof, it is to be understood that the invention is not limited to the specific embodiments thereof except as defined in the appended claims.

What is claimed is:

1. A pin for a sweeper for cleaning pipe, comprising:

A shaft portion;

an anchoring portion provided at a lower end of said shaft portion for being driven into the sweeper to prevent the pin from falling out of the sweeper; and a head portion provided at an upper end of said shaft portion;

said head portion having a plurality of spaced, pointed projections having respective tip portions, said projections being disposed in such a manner that the tip portions thereof have a non-overlapping arrangement when said head portion is viewed from a side thereof.

2. The pin according to claim 1, wherein sad pointed projections are of a generally triangular pyramidal shape.

3. The pin according to claim 1, wherein said pointed projections are of a generally quadrangular pyramidal shape.

4. A pin for a sweeper for cleaning pipe, comprising;

a shaft portion;

an anchoring portion provided at a lower end of said shaft portion for being driven into the sweeper to prevent the pin from falling out of the sweeper; and a head portion provided at an upper end of said shaft portion;

said head portion comprising a plurality of plate-shaped bodies, each of which has corner portions, stacked on one another and successively angular offset in the same direction in such a manner that equal angles are formed between corresponding corner portions of mutually adjacent ones of said plate-shaped bodies.

5. The pin according to claim 4, wherein a groove is formed in an upper surface of the head.

6. A pin for a sweeper for cleaning pipe, comprising;

a shaft portion;

an anchoring portion provided at a lower end of said shaft portion for being driven into the sweeper to prevent the pin from falling out of the sweeper; and a head portion provided at an upper end of said shaft portion;

said head portion comprising a gear-shaped body having a plurality of corner portions that define vertically extending straight lines parallel to the shaft portion.

7. The pin according to claim 6, wherein a groove is formed in an upper surface of the head.

* * * * *